US007080466B2

(12) United States Patent
Fischbein

(10) Patent No.: US 7,080,466 B2
(45) Date of Patent: Jul. 25, 2006

(54) ARTICLE OF FOOTWEAR

(76) Inventor: Amy J. Fischbein, 1471 Roosevelt Pl., Pelham Manor, NY (US) 10803

( * ) Notice: Subject to any disclaimer, the term of this patent is extended or adjusted under 35 U.S.C. 154(b) by 61 days.

(21) Appl. No.: 10/888,320

(22) Filed: Jul. 9, 2004

(65) Prior Publication Data

US 2005/0016025 A1 Jan. 27, 2005

Related U.S. Application Data

(60) Provisional application No. 60/489,329, filed on Jul. 22, 2003.

(51) Int. Cl.
*A43B 1/02* (2006.01)
*A43C 11/00* (2006.01)

(52) U.S. Cl. ..... 36/9 R; 36/50.1; 36/9 A

(58) Field of Classification Search ..... 36/9 A, 36/9 R, 50.1
See application file for complete search history.

(56) References Cited

U.S. PATENT DOCUMENTS 2,119,233 A * 5/1938 Judkins ..... 36/11.5
2,534,975 A * 12/1950 Johnson ..... 36/11.5
2,611,977 A * 9/1952 Masanori ..... 36/11.5
2,747,301 A * 5/1956 Crane ..... 36/9 A
D192,210 S * 2/1962 Webster et al. ..... D2/916
3,775,873 A * 12/1973 Small ..... 36/11.5
4,751,784 A * 6/1988 Petker et al. ..... 36/9 R
D494,746 S * 8/2004 Gomez-Tagle-Mendez .. D2/916

* cited by examiner

*Primary Examiner*—Ted Kavanaugh
(74) *Attorney, Agent, or Firm*—Mintz Levin Cohn Ferris Glovsky and Popeo, P.C.

(57) ABSTRACT

An article of footwear is provided which may include a base area for receiving the sole of a foot, a first strap projecting out from a first side of the base and having a first mating portion and a second strap projecting out from a second side of the base opposite to the first side and having a second mating portion. The base, first strap and second strap are integral with one another being constructed from a single piece of material and upon the first mating portion being mated with the second mating portion, thereby forming a mating area, the first and second straps traverse the base forming an opening for receiving and retaining a foot to the base.

2 Claims, 2 Drawing Sheets

ARTICLE OF FOOTWEAR

CLAIM TO PRIORITY

The present application claims priority under 35 U.S.C. §119(e) to U.S. provisional patent application No. 60/489,329, filed Jul. 22, 2003, the entire disclosure of which is herein incorporated by reference in its entirety.

FIELD OF THE PRESENT INVENTION

Embodiments of the present invention are directed toward a novel footwear device and/or design, which may be used as footwear in any capacity or as part of a larger footwear system. Moreover, other embodiments of the present invention are directed toward a method of forming and/or assembling an article of footwear.

BACKGROUND OF THE INVENTION

Slippers and slipper like shoes/sandals and sneakers are articles of footwear which are generally used around the house as a means for covering and/or protecting the feet, although such articles may be used as footwear for working in and outside the home, and for attending public areas and the like. People like to wear slipper-like footwear because of their convenience—they are very easy to get on or off, as opposed to traditional shoes and sneakers.

Although people use such footwear predominately at home, it would be convenient to use them other places, like, for example, when using an unfamiliar bathroom area: a public bathroom facility at a beach or pool, a hotel bathroom, so that feet may be protected from debris and germs. Slipper-like articles would be preferred in such embodiments since they could easily be slipped on or off, and are usually on the feet a short amount of time.

However, when traveling, although people could take their slippers with them, they generally do not since the articles take up precious room in a suitcase or sports bag, or are just too inconvenient to carry. Thus, the slippers remain at home and most people either have to use sneakers, shoes or bare feet when walking into areas they would otherwise use slipper-like articles of footwear.

SUMMARY OF THE INVENTION

Accordingly, embodiments of the invention address the concerns raised above and present a novel and non-obvious product and method of making the same. Moreover, such a product and process are very inexpensive—so much so, that the embodiments of the invention could be made to be disposable. Such an article of footwear would be ideal for use in hotels, for example. Although embodiments of the present invention will be generally referred to and detailed as a "slipper", embodiments of the invention are not limited to such, and use of the terms "slipper" or "slippers" is meant merely as an example. In that regard, some embodiments of the present invention may be directed to shoe, sneaker and sandal like articles of footwear to be used in any environment or situation.

Some embodiments of the present invention could be used as an accessory supplied in each room of a hotel, for example. After a patron checks out, they may take the footwear with them, or leave them behind where the hotel could either dispose of them or clean them to be re-used. Alternatively, individuals could buy packets of such articles, which when in an unassembled form, are very compact (e.g., flat—carried either like a stack of paper, or, for example, rolled up).

As previously mentioned above, some embodiments of the present invention are directed to an article of footwear that may be used indoors as well as outside, in any capacity. Moreover, depending upon the intended use of the article, the article may be made of a material appropriate for its intended use. For example, if an embodiment of the present invention is intended to be used outdoors, say, working in a garden, or in water, the article may be manufactured from a rubber based material. If the article is intended for use as a stylish accessory, it may be made from leather.

In that regard, in a first embodiment of the invention, an article of footwear may include a base area for receiving the sole of a foot, a first strap projecting out from a first side of the base and having a first mating portion and a second strap projecting out from a second side of the base opposite to the first side and having a second mating portion. The base, first strap and second strap are integral with one another being constructed from a single piece of material and upon the first mating portion being mated with the second mating portion, thereby forming a mating area, the first and second straps traverse the base forming an opening for receiving and retaining a foot to the base.

In another embodiment of the invention, an article of footwear includes a base area for receiving the sole of a foot and a first strap projecting out from a first side of the base and having a first mating portion positioned on a distal end of the first strap and comprising a slot positioned on a front side of the first strap. The article may also include a second strap projecting out from a second side of the base opposite to the first side and having a second mating portion comprising a corresponding slot positioned on a back side of the second strap. The base, first strap and second strap are integral with one another being constructed from a single piece of material. Upon the first mating portion being mated with the second mating portion, thereby forming a mating area, the first and second straps form a single strap which traverses the base forming an opening for receiving and retaining a foot to the base. Moreover, at least one of a distal end of the first strap and a distal end of the second strap include a projection which extends beyond the mating area, where the projection includes a shape resembling an object selected from the group consisting of: an ear of an animal, the antler of an animal, one side of a bow tie, one side of an eye-glass, a hand, a foot of an animal or human, at least one flower petal, an antenna, an eye, an ear of a human, and a ribbon.

In yet another embodiment of the invention, a method for making an article of footwear includes cutting, from a single piece of material, a base area for receiving the sole of a foot, a first strap projecting out from a first side of the base and a second strap projecting out from a second side of the base opposite to the first side. The base, first strap and second strap are integral with one another and upon mating a distal end of the first strap with a distal end of the second strap, the first and second strap form a single strap which traverses the base forming an opening for receiving and retaining a foot to the base.

These and other embodiments, objects, features and advantages of the invention will be better understood with reference to the attached drawings (briefly described below) and following detailed description of the embodiments.

DETAILED DESCRIPTION OF THE EMBODIMENTS

Figure 1:
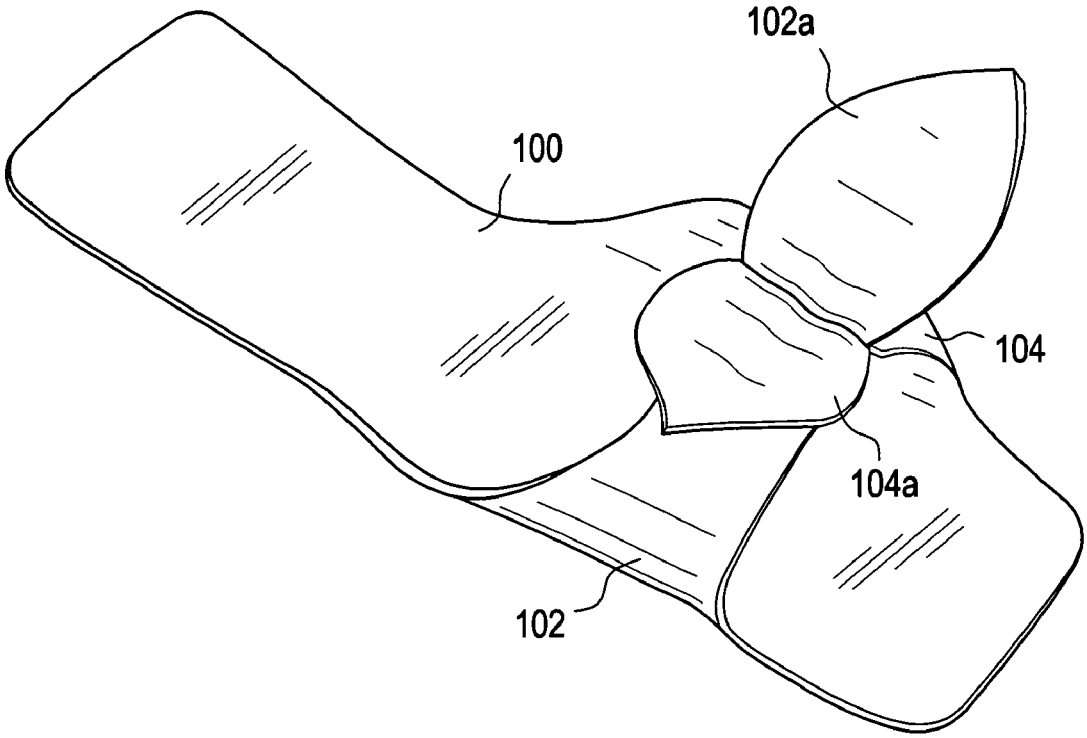
FIG. 1 illustrates a perspective view of one embodiment of the present invention.
Figure 2:
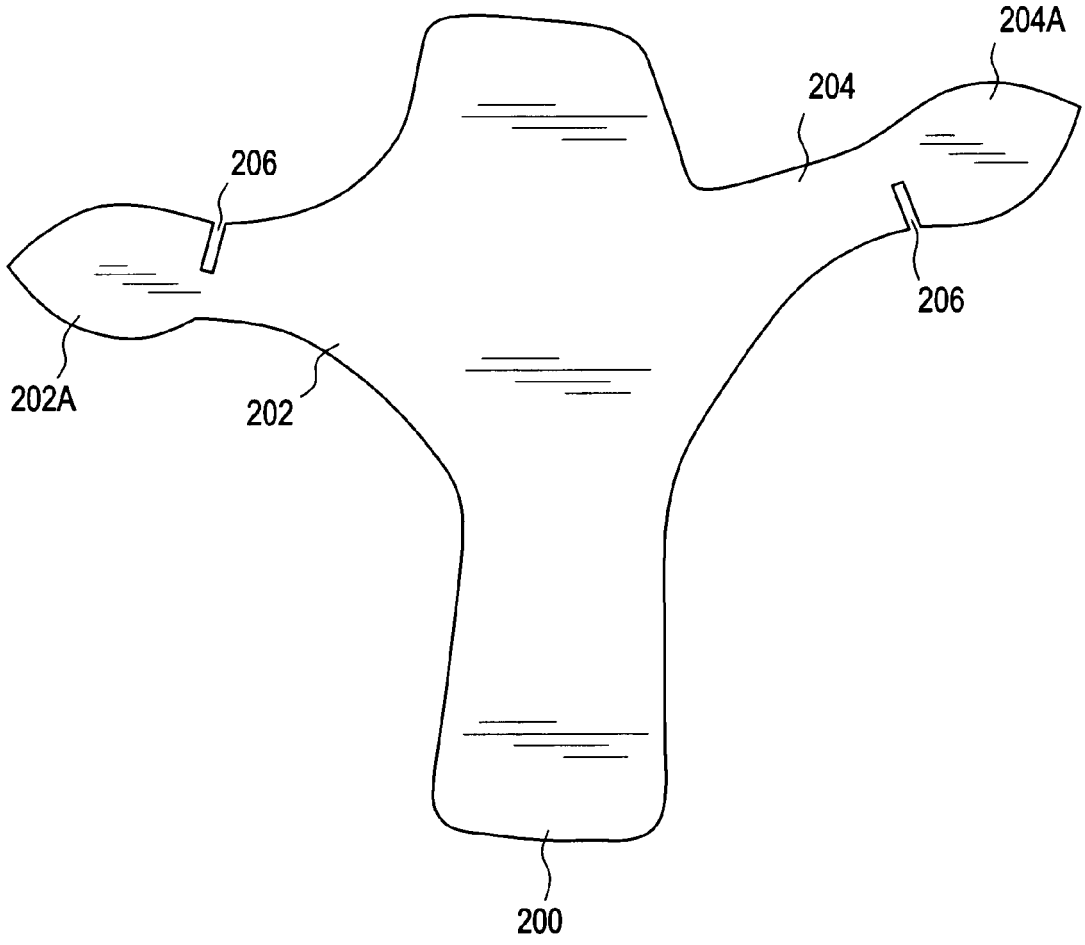
FIG. 2 illustrates a top view of a pattern for forming some of the embodiments of the present invention.

As shown in FIGS. 1 and 2, an article of footwear (e.g. a slipper) includes a base portion 100 for positioning adjacent the sole of the foot of a person. The footwear may also include interlocking members (straps) 102 and 104, which may include extensions 102*a* and 104*a*. In some embodiments of the present invention, the extensions may be formed into any design, or include any design, including, for example, the ears of an animal, eyes, clothing accessories (e.g., a tie), hands, feet, and the like.

For example, in one preferred embodiment, each extension may be formed to form one side of a "bow-tie" or "bunny-ears", such that when the interlocking members are connected, the bow-tie or a pair of bunny ears are formed. In another preferred embodiment, the extensions may be formed into portions of a flower, such that upon connection of the interlocking members, a completed flower is formed. Further yet, the extensions may be formed, for example, into ears of other animals (e.g., fox, cat, and the like), such that upon connection of the interlocking members, the ears of a particular animal are displayed in a pair.

As shown in FIG. 2, in some embodiments of the present invention, the article of footwear shown in FIG. 1 may be formed out of a single piece of material (or layers of material—e.g., a laminate). As shown, the material includes base portion 200, portions 202 and 204 which form the interlocking members (straps) 102 and 104, respectively. Thus, in some embodiments of the invention, the base and straps are integral with one another (i.e., being cut in a single piece out of a single piece of material).

Corresponding slots 206, for example, which provide one example of a novel method of assembly for an article of footwear, may be used connect (assemble) the two interlocking portions together. Other means and methods of assembling members 102/202 and 104/204 may be used (e.g., buttons, snaps, zippers, clips, staples, adhesive, welding, and the like) apart from or in addition to the slots 206. The slots may be of any size familiar to one of skill in the art which allow the interlocking members to interlock. For example, the slots may be sized such that the width of the slot may be less than the thickness of the material which forms the interlocking members, so that the interlocking members may be frictionally (for example) fit within the slot. In addition, the length of the slot may be such that it receives at least, for example, about twenty-five percent (25%) or more of the corresponding portion of the associated interlocking member, and more preferably about fifty percent or more of the corresponding portion of the associated interlocking member, and most preferably about 100% or more of the corresponding portion of the associated interlocking member.

Extensions 202*a* and 204*a*, corresponding to extensions 102*a* and 104*a* of FIG. 1, as previously stated, may be used to adorn the article of footwear (in unassembled and assembled forms) with a decorative and/or functional aspects. As stated above, the extensions may be used to present, for example, to display (in an assembled state) any one or more of a flower, ear(s)/antenna of an animal, an article of clothing, and the like.

The material for the article of footwear may be natural or synthetic, and may be any thickness, but preferably is between about 1 mm and 25 mm or more, and, in some embodiments, most preferably between about 1 mm and 10 mm, and most preferably between about 1 mm and 6 mm. Moreover, as previously stated, the material may comprise a single layer of a single material or multiple layers (which may be adhered and/or fastened together) of one or more the same, similar or different materials.

Having now described some of the embodiments of the invention, it should be apparent to those skilled in the art that the foregoing is merely illustrative and not limiting, having been presented by way of example only. Numerous modifications and other embodiments are within the scope of ordinary skill in the art and are contemplated as falling within the scope of the invention.

What is claimed is:

1. An article of footwear comprising:

a base for receiving the sole of a foot;

a first strap projecting out from a first side of the base and spaced apart from ends of the base and having a first mating portion comprising a single first slot located proximate the end of the first strap; and a second strap projecting out from a second side of the base and spaced apart from ends of the base and opposite to the first side and having a second mating portion comprising a single second slot located proximate the end of the second strap, wherein:

the base, first strap and second strap are integral with one another; and upon the mating of the first and second slots, the first and second straps traverse the base, spaced apart therefrom, forming an opening for receiving and retaining a foot to the base, and wherein at least one end of the first strap and second strap forms a projection which extends upwardly and outwardly toward a side of the base opposite the respective side of the base for which the respective strap originates.

2. The article of footwear according to claim 1, wherein the projection includes a shape resembling an object selected from the group consisting of: an ear of an animal, the antler of an animal, one side of a bow tie, one side of an eye-glass, a hand, a foot of an animal or human, at least one flower petal, an antenna, an eye, an ear of a human, and a ribbon.

* * * * *